United States Patent [19]

Tate

[11] Patent Number: 4,821,780

[45] Date of Patent: Apr. 18, 1989

[54] MULTI-LAYER FABRIC FOR PAPER-MAKING

[75] Inventor: Takuo Tate, Hachioji, Japan

[73] Assignee: Nippon Filcon Co. Ltd., Tokyo, Japan

[21] Appl. No.: 127,395

[22] Filed: Dec. 2, 1987

[30] Foreign Application Priority Data

Dec. 2, 1986 [JP] Japan ..... 61-285963

[51] Int. Cl.[4] ..... D21F 7/10

[52] U.S. Cl. ..... 139/383 A; 139/413; 139/425 A; 162/DIG. 1; 428/225

[58] Field of Search ..... 139/383 A; 428/225, 428/257, 258; 162/348, DIG. 1

[56] References Cited

U.S. PATENT DOCUMENTS

| | | | |
|---|---|---|---|
| 3,885,602 | 5/1975 | Slaughter . | |
| 3,885,603 | 5/1975 | Slaughter . | |
| 4,515,853 | 5/1985 | Borel | 139/383 A |
| 4,554,953 | 11/1985 | Borel et al. | 139/383 A |
| 4,592,396 | 6/1986 | Borel et al. | 139/383 A |
| 4,642,261 | 2/1987 | Fearnhead | 139/383 A |

FOREIGN PATENT DOCUMENTS

| | | | |
|---|---|---|---|
| 731243 | 2/1943 | Fed. Rep. of Germany | 139/383 A |
| 59-42116 | 10/1984 | Japan . | |
| 59-42117 | 10/1984 | Japan . | |

*Primary Examiner*—Henry S. Jaudon

*Attorney, Agent, or Firm*—Fleit, Jacobson, Cohn & Price

[57] ABSTRACT

A multi-layer fabric for paper-making comprising at least two fabric layers A and B, each of which is formed by inter-weaving respective warps and wefts. An upper-most layer A is woven as a plain weave 1/1 except at binding points S1, S3 and is adapted to support a paper-web thereon. A lower layer B is positioned below the upper-most layer A, and formed by warps 3 and wefts 4, 4*a*, each of which have larger diameters than those of the upper-most layer A. The upper-most layer A and the lower-most layer B are bound by means of a part 1*a* of the warps 1 of the upper-most layer A being interwoven with a part 4*a* of the wefts 4 of the lower-most layer, or by means of separate binder threads 5 other than the warps or wefts being interwoven with the upper-most layer A and the lower-most layer B. At the binding points, a warp 1*a* of the upper-most layer which intersects with a weft 4*a* of the lower-most layer B or with a binder thread 5 is extended under three successive wefts 2*a*. A weft 2*a* of the upper-most layer A at the binding point S1 is extended above three successive warps 1, 1*a*, 1 of the upper-most layer A.

2 Claims, 3 Drawing Sheets

MULTI-LAYER FABRIC FOR PAPER-MAKING

BACKGROUND OF THE INVENTION

1. Technical Field

The present invention relates to a multi-layer fabric for paper-making and in particular, to a multi-layer fabric for use in a wire part of a paper-making process in which paper-fiber dispensed water is passed onto said fabric and dewatered to form a paper web having a smooth surface.

2. Background Art

Early paper making fabrics were of metal wires made from phosphor bronze material. Recent ones are made of plastic wire consisting essentially of synthetic resins. Further, the plastic wires, which were originally of a single layer structure, have been replaced by rigid double layer structure wires in order to improve the quality of the paper sheet formed on the plastic wires and to speed up the paper making process. As this type of fabric there are known a single warp-double weft layer type fabric, i.e. a fabric consisting of a a double layer of weft threads interwoven with a single layer of warp threads, and a double warp-double weft layer type fabric, i.e. a fabric consisting of a double layer of weft threads combined with a double layer of warp threads. These double layer fabrics have advantages in that, on one hand, a paper-side surface of the fabric can provide a smooth paper surface because the paper-side of the fabric can have a finer weave pattern, and on the other hand, a machine-side surface of the fabric can be constituted by larger size rigid materials so that the machine-side surface can withstand abrasive wear by supporting members when the fabric is rotated at high speed.

In a single warp-double weft layer type fabric, a single warp appears on both sides, i.e. the paper-side and the the machine side. In contrast, however, in a double warp-double weft layer type fabric, an upper layer and a lower layer each have a combination of respective warps and wefts. Therefore, this fabric provides the above advantages more effectively.

However, actually, the double warp-double weft type fabric has disadvantages resulting from binding the upper-most layer and the lower-most layer. This type of multi-layer fabric is known, for example, from the Japanese Patent Publication No. 59-42116 corresponding to U.S. Pat. No. 3,885,603. The binding manner shown in this publication results in unevenness or ruggedness on the paper-side surface of the fabric to thereby produce wire-marks on the paper sheet formed on the fabric.

FIG. 6 shows a schematic sectional view taken along a binder thread 10 of the fabric consisting of a double layer of weft threads combined with a double layer of warp threads in which the upper-most layer A and the lower-most layer B are integrally bound by a method similar to the one disclosed in said publication.

Referring to FIG. 6, said disadvantages will be explained in more detail.

In FIG. 6, reference numeral 6 denotes a warp of the upper-most layer A, reference numeral 7 denotes a weft of the upper-most layer A, reference numeral 8 denotes a warp of the lower-most layer B, and reference numeral 9 denotes a weft of the lower-most layer B.

The fabric illustrated in FIG. 6 consists of the upper-most layer A having a plain textile weave 1/1 and the lower-most layer B having a twill textile weave 2/1 which is coarser than the upper-most layer A, the layers A and B being integrally bound by means of the binder thread 10 having a diameter smaller than the warp and weft threads. This textile weave of the fabric is typical of ones now actually utilized in paper-making machines.

Generally, the plain textile weave 1/1 of the upper-most layer A has more upper-knuckles of warps and wefts than other textile weaves. These knuckles support a paper-web formed thereon and are evenly arranged at the same level. This makes it possible to obtain a paper surface which is smoother and has less wire-marking.

However, when the upper-most layer A and the lower-most layer B are bound as shown in FIG. 6, the warp 6*a* intersecting with the binder thread 10 is pulled downwards, so that on both sides the warps and wefts adjacent the intersecting point, i.e. the binding point, are also downwardly displaced, resulting in dimples 11 as shown by hatching in FIG. 6. The paper web formed on the upper surface of this fabric is thicker at the portion corresponding to the dimples 11 than other portions, resulting in varying thickness of the paper sheet. Further, since these thicker portions are formed on respective binding points or binding portions, these thicker portions appear as diagonal or lateral streak patterns on the paper. Such unevenness of the paper sheet surface results in impaired printability of the paper sheet.

Further, since the binder thread 10 is interwoven with the warps 6*a* in such a manner that it is wedged in between wefts 7, the distance between wefts 7 at the binding portions is expanded, and the adjacent warps 6 also are pushed through the wefts 7 so that the distance between the warps 6 are also expanded. As a result, it is impossible for the fabric to maintain the uniform wire mesh size thereof.

Further, since the binder thread 10 is wedged between warps 6*a* and 6 and between wefts 7 and 7, the wire mesh space is greatly decreased.

This results in uneven thickness of the paper web because of partially uneven dewatering from the paper web, and this uneven thickness appears as longitudinal, lateral, or diagonal wire-marks on the paper sheet, leading to significantly impaired paper quality.

As described above and shown in FIG. 6 and said Japanese Patent Publication No. 59-42116, even when the binder thread 10 has a smaller diameter than those of the weft and warp, the prior art fabrics have the above disadvantages, and when the upper-most layer and the lower-most layer are bound by means of the warps or wefts of the fabric without using the binder thread 10, the above disadvantages will become more notable, and as a result, these fabrics cannot be practically utilized.

In the present specification and claims, "warp" and "weft" mean two groups of threads interwoven with each other and intersected at a right angle (as seen in the plan view) with each other, one group being called the "warp" and the other group being called as the "wefts". Accordingly, the "warp" and "weft" are independent from whether they extend longitudinally or laterally during weaving, or whether they extend in a machine direction or in a cross-machine direction during use. Thus they are interchangeable as textile weave.

SUMMARY OF THE INVENTION

It is an object of the present invention to provide an improved multi-layer fabric for paper-making which is free from the above described disadvantages of the prior art.

The multi-layer fabric for paper-making in accordance with the present invention comprises at least two fabric layers, each of which is formed by interweaving respective warps and wefts with each other, an upper-most layer of said layers being woven as a plain weave except at binding portions and being adapted to support a paper slurry thereon, a lower layer of said layers positioned below said upper-most layer being formed by warps and wefts each of which have larger diameters than those of said upper-most layer, said upper-most layer and said lower layer being bound by means of a part of the warps of said upper-most layer being interwoven with a part of the wefts of said lower layer or by means of binder threads interlaced with some of the warps of said upper layer and with some of the warps of said lower layer respectively. The binder threads are separate from the warps and wefts which form the upper and lower fabric layers so that at the binding portions, a warp of said upper-most layer is interlaced with a weft of said lower layer or with a binder thread and extends under three successive wefts of said upper-most layer, and a weft of said upper-most layer extends above three successive warps of said upper-most layer.

A part of the warps of said upper-most layer may be interwoven with a part of the wefts of said lower layer to thereby combine said upper-most layer and said lower layer.

Alternatively, separate binder threads other than warps or wefts may be interwoven with said upper-most layer and said lower layer respectively to thereby combine said upper-most layer and said lower layer.

The lower fabric layer may be a single layer fabric.

In accordance with another embodiment of the present invention, said lower layer consists of a double layer of weft threads interwoven with a single layer of warp threads.

BRIEF DESCRIPTION OF THE DRAWINGS

Other advantages of the present invention will be readily appreciated as the same becomes better understood taken in reference to the accompanying drawings wherein.

DETAILED DESCRIPTION OF THE PREFERRED EMBODIMENTS

Figure 1:
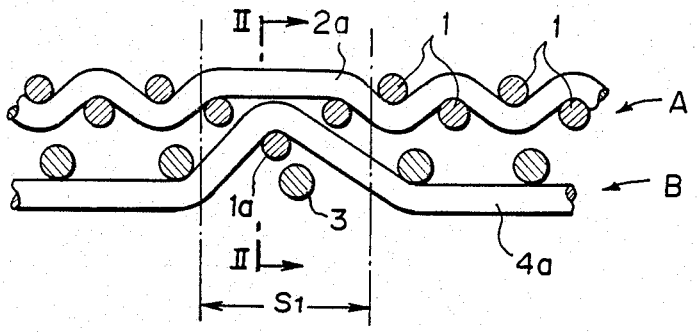
FIG. 1 is a cross sectional view of a first embodiment of the present invention, showing binding portions of the multi-layer fabric.
Figure 2:
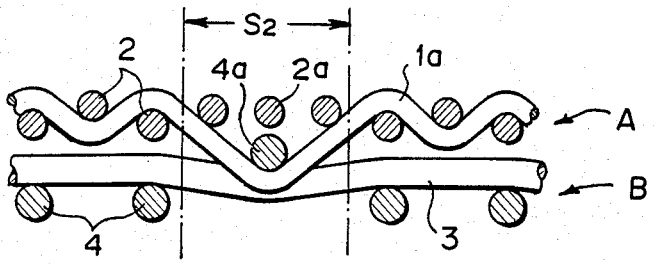
FIG. 2 is a longitudinal sectional view of the first embodiment of the present invention taken along the line II—II of FIG. 1.

FIG. 1 is a cross sectional view of the binding portion of one multi-layer fabric of the first embodiment of the present invention taken along the weft direction with a part 1*a* of warp 1 of the upper-most layer A being intersected with a part 4*a* of weft 4 of the lower-most layer B to integrally bind the layers A and B with each other. Reference numeral 2*a* denotes a weft of the upper-most layer A. Reference numeral 3 denotes a warp of the lower-most layer B. FIG. 2 is a longitudinal sectional view of the first embodiment taken along the line II—II of FIG. 1, showing part of the binding portion.

The upper-most layer A, as shown in the figures, is of 1/1 plain textile weave pattern except for the binding portions S (S1, S2, S3, S4) and the lower-most layer A is not limited to a specific textile weave pattern and may be, for example, of 2/1 twill textile weave pattern as shown in FIGS. 1–4.

At the binding portion S1 (FIG. 1), weft 4*a* of the lower-most layer B passes under two successive warps 3 of the layer B, extends upwardly between one of said two warps 3 and adjacent warp 3, and then extends upwardly between two successive warps 1 and 1*a* of the upper-most layer A, and then extends downwardly between two successive warps 1*a* and 1 adjacent said two warps 1 and 1*a*, and passes under two successive warps 3.

Therefore, in the binding portion S1, weft 2*a* of the upper-most layer A extends over three successive warps 1 of the layer A, the middle warp 1 of which is interwoven with weft 4*a* of the lower-most layer B so that the upper-most layer A and the lower-most layer A are integrally bound by means of warp 1*a* and weft 4*a*.

Such binding portions S1 may be arranged in all positions where weft 4*a* is positioned over warp 3 or may be intermittently arranged at a predetermined distance. Also, all the wefts 4*a* of the lower-most layer B may be bound with warp 1*a* or only a part of the wefts 4, for example, every third weft 4 or every twenty-first weft 4, may be bound with warp 1*a*. At such binding portions, weft 2*a* of the upper-most layer A extends over three successive warps 1, 1*a*, 1 (S1 of FIG. 1), middle warp 1*a* of which extends under three successive wefts 2, 2*a*, 2 of the upper-most layer A and under weft 4*a* positioned above warp 3 of the lower-most layer B (S2 of FIG. 2) to thereby bind the layers A and B.

Figure 4:
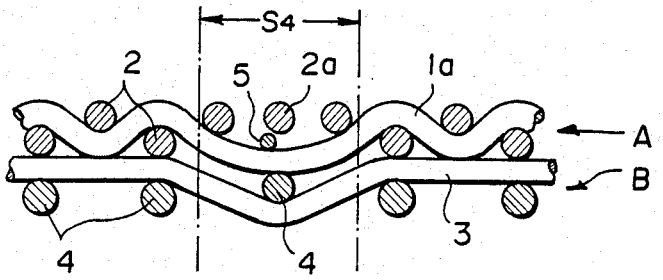
FIG. 4 is a partial sectional view taken along line IV—IV of FIG. 5.
Figure 3:
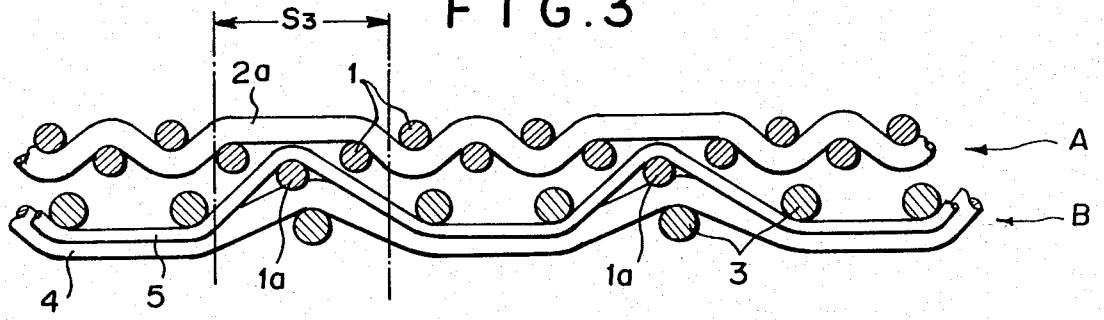
FIG. 3 is a partial sectional view of a second embodiment of the invention taken along line III—III of FIG. 5.
Figure 6:
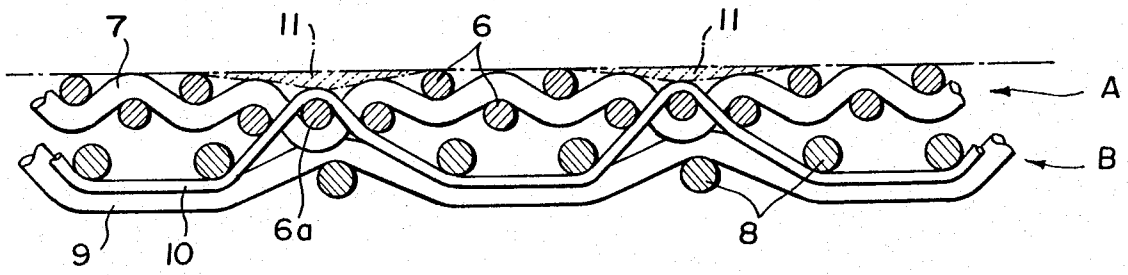
FIG. 6 (PRIOR ART)
FIG. 5 is a partial plan view of this embodiment of the present invention and FIG. 6 is a partial sectional view of the prior art multi-layer fabric discussed above.
Figure 5:
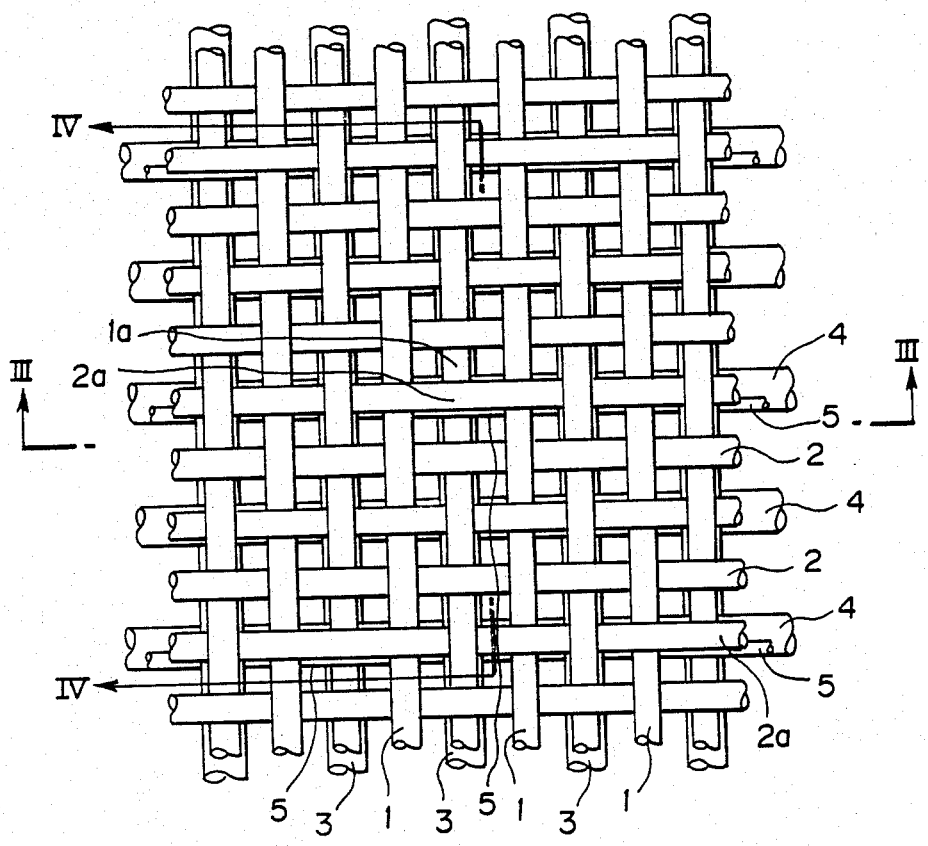

FIGS. 3, 4 and 5 show a second embodiment of the present invention, illustrating an example of the multi-layer fabric with the upper-most layer A and the lower-most layer B being bound by means of binder thread 5 separate from warps or wefts constituting the upper-most layer A and the lower-most layer B. FIG. 5 shows a partial plan view of the second embodiment of the present invention, and FIG. 3 is a cross-sectional view taken along line III—III of FIG. 5, and FIG. 4 is a longitudinal sectional view taken along line IV—IV of FIG. 5. In FIGS. 3, 4 and 5, reference numerals 1, 2, 3, 4, and 5 depict a warp of the upper-most layer A, a weft of the layer A, a warp of the lower-most layer B, a weft of the layer B, and a binder thread, respectively.

In this fabric, binder thread 5, as shown in FIG. 3, extends substantially parallel to weft 4 except at binding portion S3 (FIG. 3), and in the binding portion S3, the binder thread 5 is positioned above warp 1*a* of the layer A and above warp 3 of the layer B. In this binding portion S3, weft 2*a* of the upper-most layer A extends above three successive warps 1, 1*a*, 1 of the layer A (FIG. 3), and the middle warp 1*a* of said three successive warps extends under three successive wefts 2, 2*a*, 2 and under the binder thread 5 to thereby bind the layers A and B to each other (FIG. 4).

The arrangement of the binding portions is the same as the above described distribution.

The lower-most layer fabric B may be either a single layer as described above, or a double layer which may consist of a double layer of weft threads interwoven with a single layer of warp threads or a double layer of weft threads combined with a double layer of warp threads.

These structures of such binding portions enable the warp 1*a* of the upper-most layer A in the binding portion to become looser, that is, when the warp 1*a* is pulled downwardly by weft 4*a* of the lower-most layer B or by binder thread 5, it may be installed or placed in position between the layers A and B without affecting surrounding portions.

Therefore, since weft 4*a* of the lower-most layer B or binder thread 5 is not wedged in between two adjacent wefts 2 of the upper-most layer A, it is possible for wefts 2 to be arranged at even pitch without enlarging the distance between them in the binding portion, and in addition, wefts 2 may be arranged at finer pitch.

Further, since weft 2*a* of the upper-most layer A in the binding portion is free from or unrestrained by warp 1*a* and extends over this warp 1*a* in the lateral direction, the weft 2*a* does not sink, so that a plain upper surface can be formed.

In addition, since weft 4*a* of the lower-most layer B or binder thread 5, in the binding portions, is piled under weft 2*a* of the upper-most layer A, the weft 4*a* or binder thread 5 does not fill the mesh openings of the fabric so that an even mesh size may be obtained to thereby ensure even drainage out of the paper web.

Accordingly, various disadvantages of the prior art described in the introduction are overcome by the present invention.

As described above, the multi-layer fabric of the present invention, owing to its unique binding structure, has the following effects and advantages:

(1) smooth paper-surface, even mesh size, and even drainage characteristic over the entire fabric surface may be obtained thereby to provide even fiber-distribution, whereby to make smoother paper;

(2) the upper-most layer A may be woven by finer threads and in fine mesh size so that the quality of the paper may be improved; and (3) The lower-most layer B may be rigidly woven by larger threads so that it can maintain the runnability of the fabric, the smooth surface thereof, tension durability, resistance against the showering water, and wear resistance.

What is claimed is:

1. Multi-layer fabric for paper-making, said fabric comprising:

an upper fabric layer and a lower fabric layer, respective warps and wefts interwoven with each other to form each of said upper and lower fabric layers, said upper layer being formed by warps and wefts woven as a plain weave except at binding portions thereof and being adapted to support a paper slurry thereon, said lower layer positioned below said upper layer and being formed by warps and wefts each having larger diameters than said warps and wefts forming said upper layer, binder threads interlaced with some of the warps of said upper layer and with some of the warps of said lower layer, respectively, to bind said upper layer and said lower layer together, said binder threads being separate from the warps and wefts which form said upper layer and said lower layer, so that at said binding portions, a warp of said upper layer is interlaced with said binder thread and extends under three successive wefts of said upper layer, a weft of said upper layer extends above three successive warps of said upper layer, each said binder thread, at said binding portions, passes upwardly between a first warp and a second warp of said three successive warps of said upper layer, above said second warp, and downwardly between said second warp and a third warp of said three successive warps of said upper layer, and said binder thread is positioned at the binding portion under said weft of said upper layer, formation of a recess in which said paper slurry can accumulate thereby being prevented.

2. Multi-layer fabric for paper-making according to claim 1, characterized in that said lower fabric layer is a single layer fabric.

* * * * *